US009217960B2

(12) United States Patent
Mori et al.

(10) Patent No.: US 9,217,960 B2
(45) Date of Patent: Dec. 22, 2015

(54) IMAGE FORMING APPARATUS

(71) Applicant: CANON KABUSHIKI KAISHA, Tokyo (JP)

(72) Inventors: Hideki Mori, Toride (JP); Keiko Fujita, Kashiwa (JP); Hiroshi Saito, Toride (JP); Hitoshi Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/561,405

(22) Filed: Dec. 5, 2014

(65) Prior Publication Data

US 2015/0168879 A1 Jun. 18, 2015

(30) Foreign Application Priority Data

Dec. 16, 2013 (JP) ..... 2013-259431

(51) Int. Cl.
*G03G 15/08* (2006.01)
*G03G 15/16* (2006.01)

(52) U.S. Cl.
CPC .... *G03G 15/1615* (2013.01); *G03G 2215/0132* (2013.01); *G03G 2215/0193* (2013.01)

(58) Field of Classification Search
CPC ..... G03G 15/1605; G03G 15/0131; G03G 2215/0154; G03G 15/1615; G03G 2215/0132; G03G 2215/0193
USPC ..... 399/121
See application file for complete search history.

(56) References Cited

U.S. PATENT DOCUMENTS 5,517,290 A * 5/1996 Marumoto et al. ..... 399/313
6,298,212 B1 * 10/2001 Kono et al. ..... 399/302

FOREIGN PATENT DOCUMENTS

JP 2001-215809 A 8/2001
JP 2003-091133 A 3/2003
JP 2003-171030 A 6/2003

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes: image bearing members; a belt unit including an endless belt; a slackness forming unit for performing a first function of forming a belt slacking region, at least at a portion where the belt opposes the image bearing members, by causing the slackness forming unit to act on the belt unit and for performing a second function of eliminating the belt slacking region; and a guiding unit for guiding the belt unit so that the slackness forming unit performs the first function in a state in which the belt is spaced from the image bearing members and so that the slackness forming unit performs the second function in a state in which the belt slacking region contacts the image bearing members.

8 Claims, 12 Drawing Sheets

IMAGE FORMING APPARATUS

FIELD OF THE INVENTION AND RELATED ART

The present invention relates to an image forming apparatus, using an electrophotographic system, such as a copying machine, a printer or a facsimile machine.

In the image forming apparatus of a tandem type using an intermediary transfer belt, photosensitive drums are provided along a substantially rectilinear line relative to the intermediary transfer belt. A primary transfer roller is provided adjacently to a contact position between the intermediary transfer belt and each of the photosensitive drums. Before start of image formation, the primary transfer roller contacts the intermediary transfer belt toward the associated photosensitive drum.

In the conventional image forming apparatus, a length of a contact portion between the intermediary transfer belt and the photosensitive drum and a length of a contact portion between the intermediary transfer belt and the primary transfer roller are substantially equal to each other. However, in this case, there is a liability that at a gap between the intermediary transfer belt and the upstream-side photosensitive drum, electric discharge generates, and thus toner scattering generates.

Therefore, in some cases, an auxiliary roller for pressing the intermediary transfer belt toward the photosensitive drum is provided to prolong the contact portion between the intermediary transfer belt and the photosensitive drum. However, there is a liability that speed non-uniformity is generated at every one of a plurality of rollers including the auxiliary roller, and thus toners of respective colors are transferred onto the intermediary transfer belt in a misregistration manner.

Therefore, in Japanese Laid-Open Patent Application (JP-A) 2003-91133, it is proposed that a length of an outer circumference of the primary transfer roller and a length of an outer circumference of the photosensitive drum are made so as to provide an integral multiple and then a color misregistration period is measured, and a color misregistration is corrected by adjusting timing of image formation by light exposure.

However, a conventional intermediary transfer unit was inserted into an image forming apparatus main assembly, and the intermediary transfer belt was contacted to the photosensitive drums while being stretched by a tension roller and a driving roller, and a mechanism for urging the intermediary transfer belt against the photosensitive drums was merely provided. For that reason, when the intermediary transfer unit is inserted into the image forming apparatus main assembly and is urged toward the photosensitive drums, a resistance due to friction is generated between the intermediary transfer belt and each of the photosensitive drums by the urging. By this resistance, there was a problem that the intermediary transfer belt rubs against the photosensitive drums while contacting the photosensitive drums.

With respect to the intermediary transfer belt, particularly in the image forming apparatus in which switching between operations in a full-color mode and a monochromatic mode is made, in a constitution in which contact and separation between the photosensitive drums for color image formation and the intermediary transfer belt are repeated, short lifetimes of the intermediary transfer belt and the photosensitive drums are problematic due to the friction (rubbing).

SUMMARY OF THE INVENTION

Objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

Figure 1:
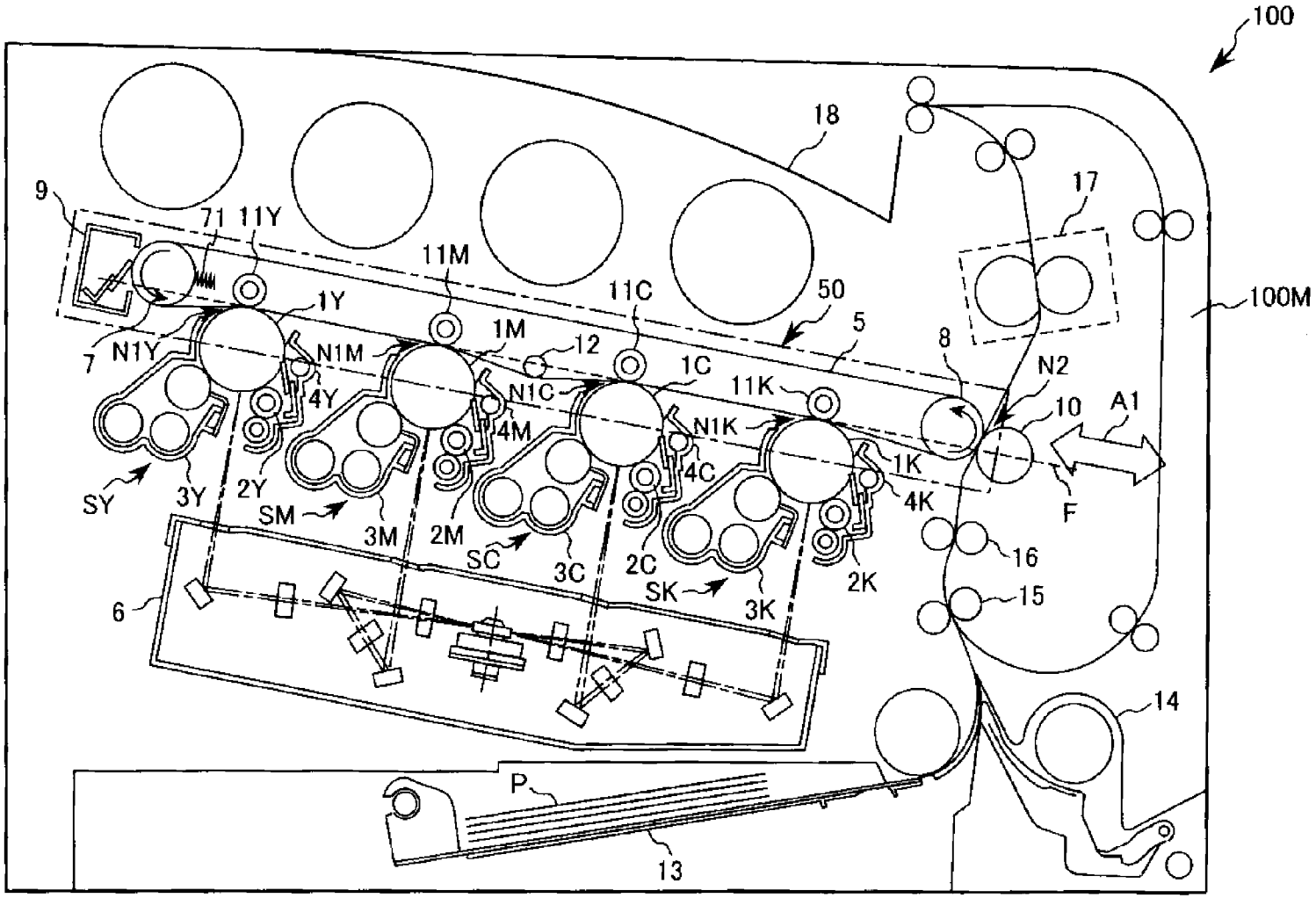
FIG. 1 is a schematic sectional view showing an embodiment of an image forming apparatus according to the present invention.

FIG. 1 is a schematic sectional view showing an embodiment of an image forming apparatus 100 according to the present invention. The image forming apparatus 100 is a tandem type full-color image forming apparatus of an electrophotographic type.

The image forming apparatus 100 includes image forming stations SY, SM, SC and SK for yellow (Y), magenta (M), cyan (C) and black (K), respectively. The image forming stations SY, SM, SC and SK for the respective colors have many common constitutions and operations except for the colors of the toners. Accordingly, in the following, in the case where particular distinction is not needed, description will be made by omitting suffixes Y, M, C and K for representing the colors of constituent elements of the image forming apparatus.

Each of the image forming stations S includes a photosensitive drum 1, and at a periphery of the photosensitive drum 1, includes a charging roller 2, a developing means 3 and a photosensitive drum cleaner 4. The image forming apparatus 100 includes an intermediary transfer belt 5 having an endless belt shape. A plurality of the image forming stations S are disposed at contact positions of the photosensitive drums 1 with the intermediary transfer belt 5 along a substantially rectilinear line relative to the intermediary transfer belt 5. Below the image forming stations S in a side opposite from a side where the photosensitive drums 1 contact the intermediary transfer belt 5, an exposure means 6 is provided. The intermediary transfer belt 5 is stretched around a tension roller 7 and a driving roller 8, and a belt cleaner 9 is provided opposed to the tension roller 7 via the intermediary transfer belt 5. At a position opposing the driving roller 8 via the intermediary transfer belt 5, a secondary transfer roller 10 is provided. At a position opposing the associated one of the photosensitive drums 1 at a back surface of the intermediary transfer belt 5, a primary transfer roller 11 as a primary transfer means is provided. Further, at the back surface of the intermediary transfer belt, i.e., in the side where the primary transfer rollers 11 are provided, an auxiliary roller 12 is provided. At an inside lower portion of the image forming apparatus 100, a sheet feeding cassette 13 in which a transfer(- receiving) material P is accommodated is provided. With respect to a feeding and movement direction of the transfer material P accommodated in the sheet feeding cassette 13, a feeding roller pair 15, a registration roller pair 16, the secondary transfer roller 10, a fixing means 17 and a discharging portion 18 are provided. Further, as an accommodating portion for the transfer material P, in addition to the sheet feeding cassette 13, a manual feeding portion 14 is provided.

Next, an image forming operation of the image forming apparatus 100 in this embodiment will be described.

The image forming apparatus 100 receives an image formation start signal from an unshown host computer or image reader or the like, and then starts the image forming operation. The four photosensitive drums 1Y, 1M, 1C and 1K are electrically charged to have uniform electric charges by the charging rollers 2Y, 2M, 2C and 2K, respectively. Into a laser scanner 6 as the exposure means, image signals for yellow (Y), magenta (M), cyan (C) and black (K) are inputted. Depending on the image signal, the surface of the associated photosensitive drum 1 is irradiated with laser light by the laser scanner 6, so that the electric charges are neutralized to form a latent image. The latent images formed on the photosensitive drums (image bearing members) 1 are developed with toners of yellow, magenta, cyan and black by the developing means 3Y, 3M, 3C and 3K. The toners used for developing the latent images on the photosensitive drums 1 are successively transferred onto the intermediary transfer belt 5 which is an endless belt-shaped intermediary transfer member, so that a full-color toner image consisting of superposed toners is formed on the intermediary transfer belt 5. A transfer residual toner remaining on each of the photosensitive drums 1 without being transferred is collected by the photosensitive drum cleaner 4.

On the other hand, a sheet P which is the transfer material such as recording paper which is fed from either one of the sheet feeding cassette 13 or the manual feeding portion 14 is fed toward the registration roller pair 16 by the feeding roller pair 15. A leading end of the sheet P abuts against the registration roller pair 16 placed in a rest state, and after oblique movement of the sheet P is corrected, rotation of the registration roller pair 16 is started in synchronism with the toner image on the intermediary transfer belt 5.

The toner image on the intermediary transfer belt 5 is transferred onto the sheet P at a secondary transfer portion N2 by the secondary transfer roller 10, and then is heated and pressed by the fixing means 17 to be fixed on the sheet P. Thereafter, the sheet P is discharged to an outside of an image forming apparatus main assembly 100M through the discharging portion 18. Further, a secondary transfer residual toner remaining on the intermediary transfer belt 5 without being transferred at the secondary transfer portion N2 is collected by an intermediary transfer belt cleaner 9.

In the image forming apparatus 100 in this embodiment, the intermediary transfer belt 5 is a part of a structure of an intermediary transfer unit 50, and the intermediary transfer unit 50 is constituted so as to be freely inserted into and dismounted from the image forming apparatus main assembly 100M of the image forming apparatus 100. The intermediary transfer unit 50 will be described.

The intermediary transfer belt 5, the tension roller 7, the driving roller 8, the auxiliary roller 12, the primary transfer roller 11 and the intermediary transfer belt cleaner 9 which are described above constitute the intermediary transfer unit 50 which integrally hold these members. The intermediary transfer unit 50 can be inserted and pulled in an arrow A1 direction along an intermediary transfer unit inserting and pulling rail (not shown) provided in the image forming apparatus main assembly 100M. Further, the intermediary transfer unit 50 includes an unshown intermediary transfer frame for rotatably supporting the tension roller 7, the driving roller 8 and the auxiliary roller 12. The tension roller 7 is movable relative to the intermediary transfer frame and is urged by a tension spring 71 in a direction of maintaining tension of the intermediary transfer belt 5. The driving roller 8 supplies a driving force to the intermediary transfer belt 5. At a surface opposing the tension roller 7 via the intermediary transfer belt 5, the intermediary transfer belt cleaner 9 is provided.

A phantom plane which is a common contact plane (surface) of the photosensitive drums 1 at the side where the photosensitive drums 1 contact the intermediary transfer belt 5 is F. After the intermediary transfer unit 50 is mounted in the image forming apparatus main assembly 100M, the respective stretching rollers 7, 8 and 12 enter the phantom plane toward the photosensitive drum 1 side. As a result, a contact region where the intermediary transfer belt 5 contacts the photosensitive drum is longer than a contact region where the intermediary transfer belt 5 contacts the primary transfer roller 11.

The stretching rollers 7, 8 and 12 constituting the intermediary transfer unit 50 are disposed in the following manner. The intermediary transfer belt 5 is stretched by the stretching rollers 7 and 8 when the intermediary transfer unit 50 is mounted in the image forming apparatus main assembly 100M and the intermediary transfer belt 5 does not contact the photosensitive drums 1. With respect to the movement direction of the intermediary transfer belt 5, each of the photosensitive drums 1 has the contact region positioned downstream of the tension roller 7 and upstream of the driving roller 8. The contact regions are regions where the intermediary transfer belt 5 contacts the photosensitive drums 1Y, 1M, 1C and 1K, respectively, in the listed order from an upstream side of the movement direction of the intermediary transfer belt 5. At positions, inside the intermediary transfer belt 5, corresponding to the respective contact regions, the primary transfer rollers are disposed.

The stretching rollers which enter the photosensitive drum side of phantom plane F described above are the tension roller 7 positioned upstream of the photosensitive drums 1 with respect to the movement direction of the intermediary transfer belt 5, the driving roller 8 positioned downstream of the photosensitive drums 1 with respect to the movement direction of the intermediary transfer belt 5, and the auxiliary roller 12 positioned between the photosensitive drums 1M and 1C. A constitution in which these stretching rollers 7, 8 and 12 enter the phantom plane F and thus the intermediary transfer belt 5 winds about the photosensitive drums 1 is employed.

Next, an operation of the intermediary transfer unit 50 in the case where the intermediary transfer unit 50 is gradually inserted into the image forming apparatus main assembly 100M will be described with reference to FIGS. 2 to 4.

Figure 2:
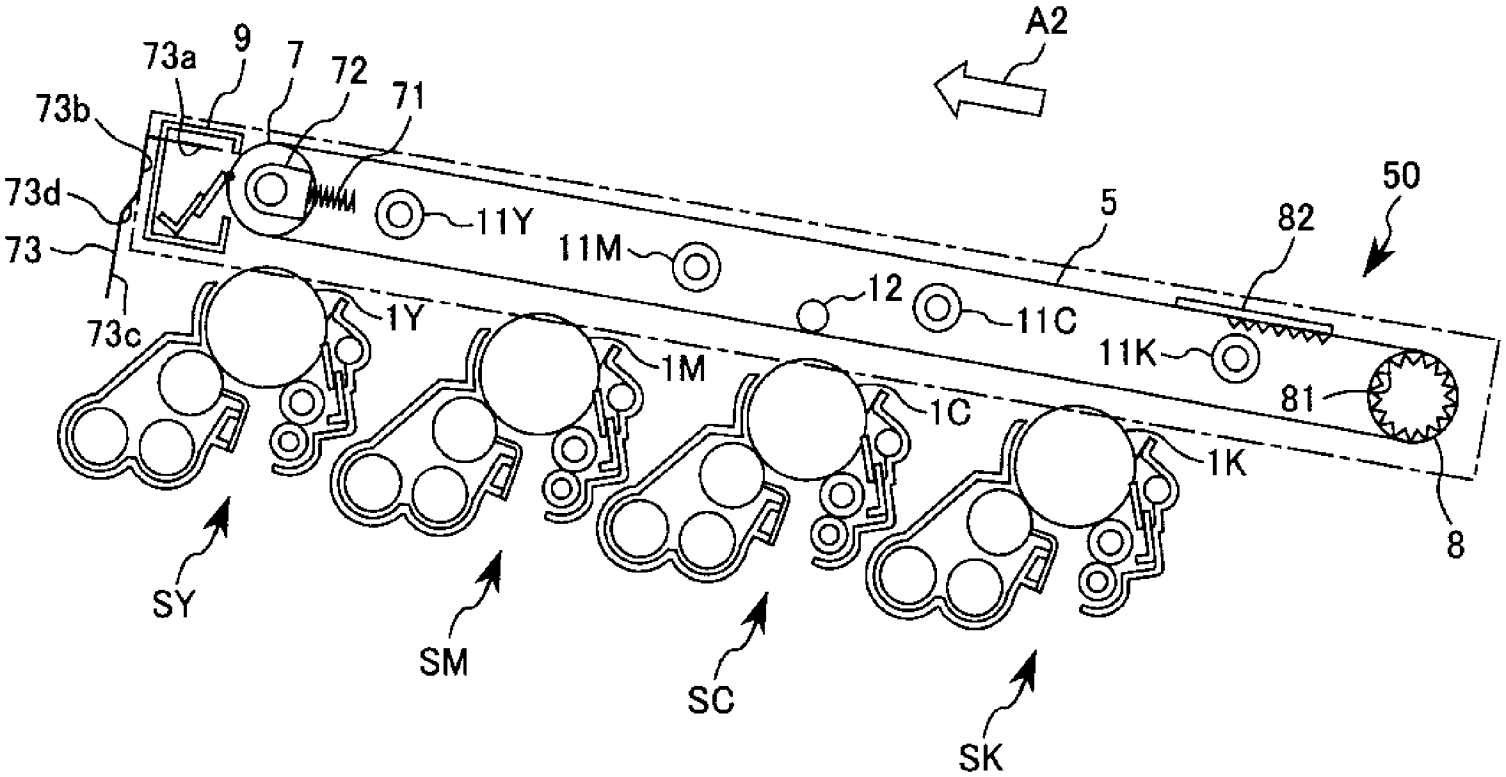
FIGS. 2 to 5 are schematic sectional views, of an image forming portion for illustrating mounting of an intermediary transfer unit of the image forming apparatus in Embodiment 1.

As shown in FIG. 2, when the intermediary transfer unit 50 is positioned outside the image forming apparatus, the intermediary transfer belt 5 is in a state in which the intermediary transfer belt 5 is stretched by only the tension roller 7 and the driving roller 8, and the intermediary transfer unit 50 is inserted into the image forming apparatus main assembly 100M in an arrow A2 direction. In the intermediary transfer unit 50, the intermediary transfer belt 5 is stretched by the tension roller 7 and the driving roller 8, and the intermediary transfer belt cleaner 9 is disposed at an opposing portion to the tension roller 7. The intermediary transfer belt 5 positioned at a sandwiching portion between the intermediary transfer belt cleaner 9 and the tension roller 7 is constituted so as to be immovable due to a resistance thereof generated by being sandwiched between the intermediary transfer belt cleaner 9 and the tension roller 7 when the intermediary transfer belt 5 is not driven by the driving roller 8.

Figure 3:
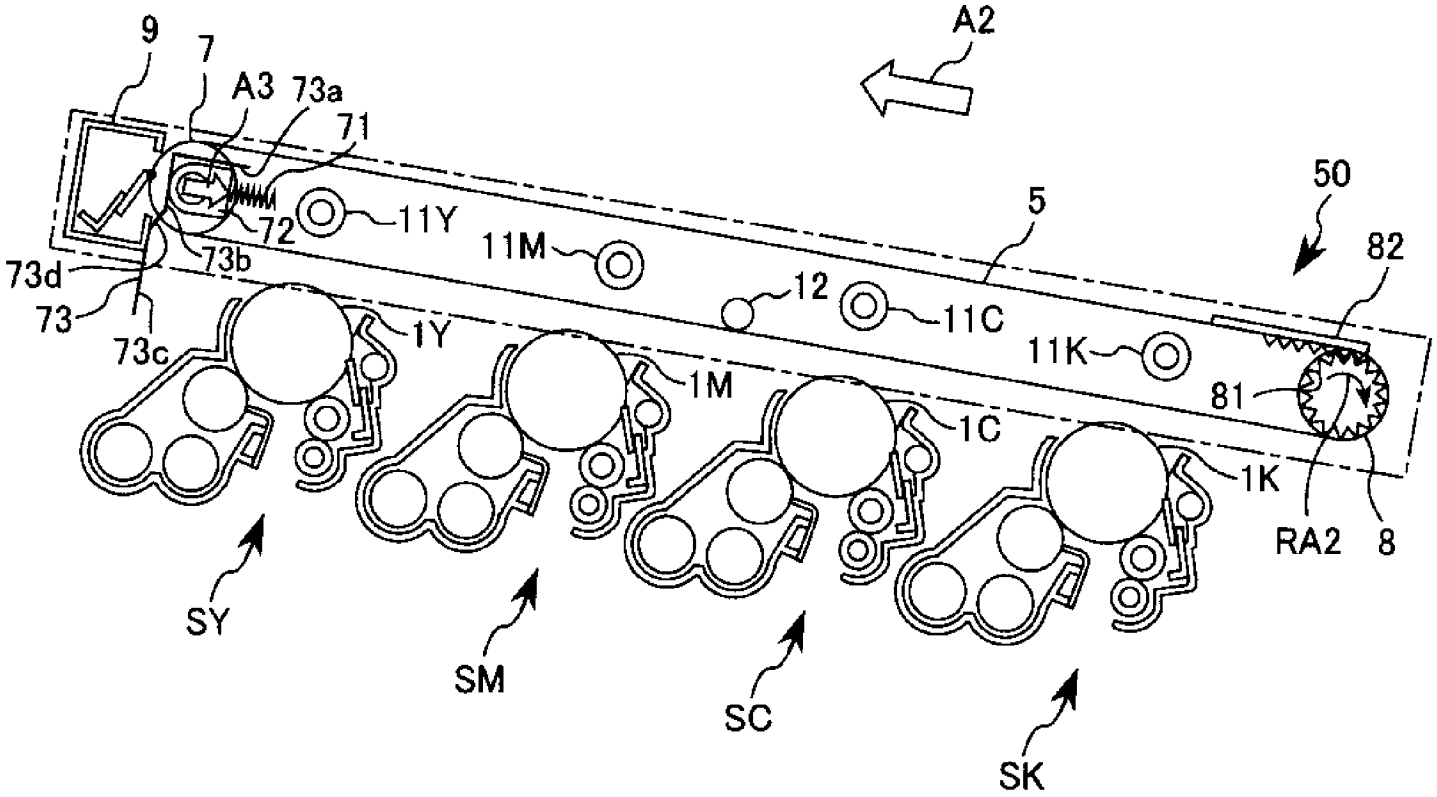

As shown in FIG. 3, a bearing member 72 of the tension roller 7 of the intermediary transfer unit 50 inserted in the arrow A2 direction is engaged with a releasing means 73 (described later specifically) for releasing the tension thereof disposed in the image forming apparatus main assembly 100M. Substantially at the same time, a gear 81 provided so as to be rotated integrally with the driving roller 8 engages with a rack 82 provided in the image forming apparatus main assembly 100M. When the intermediary transfer unit 50 is further inserted in the arrow A2 direction, the tension roller 7 moves in an arrow R direction relative to the intermediary transfer unit 50 by the action of the releasing means 73. However, as described above, due to the resistance of the intermediary transfer belt 5 generated by being sandwiched between the intermediary transfer belt cleaner 9 and the tension roller 7, the intermediary transfer belt 5 is not moved at the sandwiched portion when the intermediary transfer belt 5 is not driven by the driving roller 8. Then, the driving roller 8 is rotated integrally with the gear 81 in an arrow RA2 direction by rotation of the gear 81 engaged with the rack 82. In addition to the release of the tension of the tension roller 7, by the rotation of the driving roller 8 in the arrow RA2 direction, slackness of the intermediary transfer belt 5 is generated relatively in a contact region side where the intermediary transfer belt 5 contacts the photosensitive drums 1. As a result, as shown in FIG. 4, in the side of the intermediary transfer belt 5 opposing the photosensitive drums 1, the state of the intermediary transfer belt 5 is changed to a slacked (loosened) state.

Figure 5:
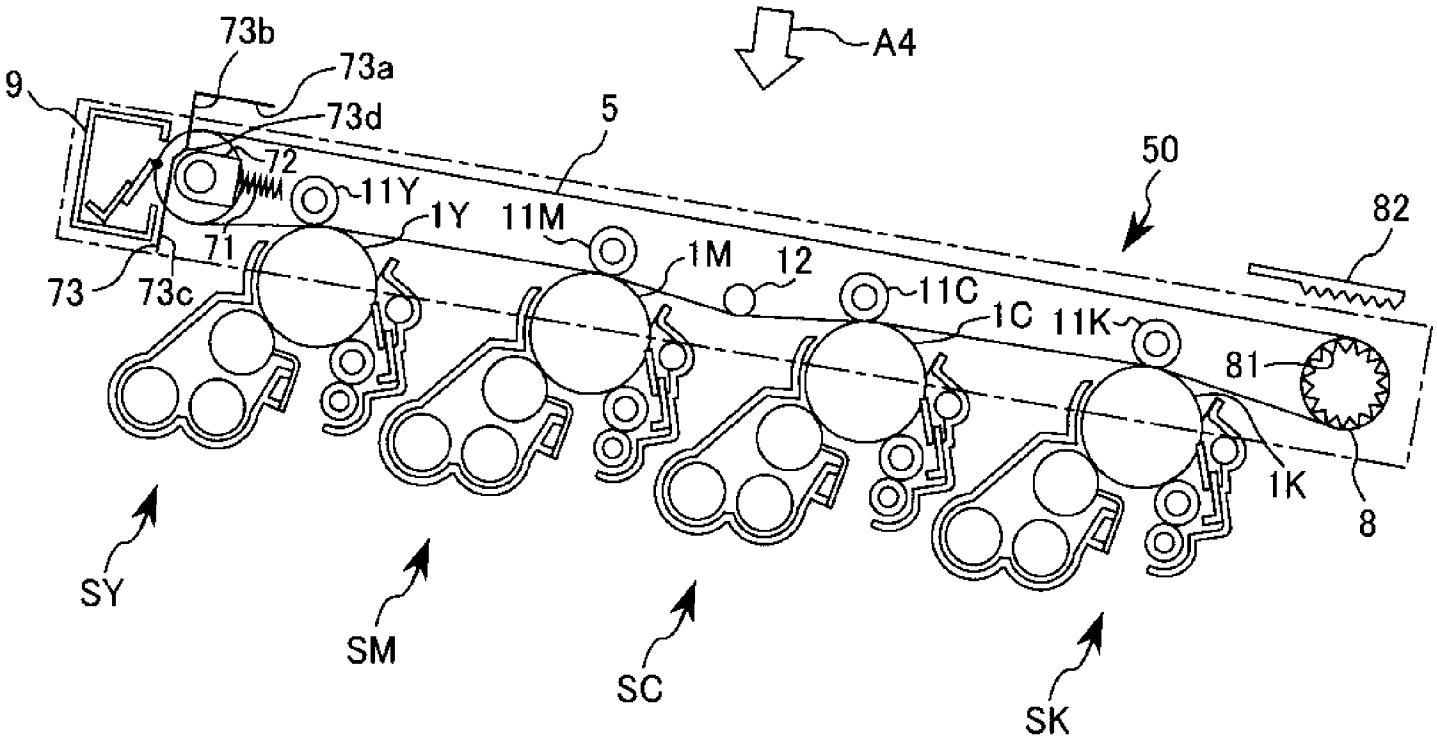

Thereafter, as shown in FIG. 5, the intermediary transfer unit 50 is moved in an arrow A4 direction, so that the intermediary transfer belt 5 contacts the photosensitive drums 1Y, 1M, 1C and 1K. The intermediary transfer unit 50 is disposed at a position where the intermediary transfer belt 5 contacts the primary transfer rollers 11 and the photosensitive drums 1 to effect image formation (hereinafter referred to as an image forming position). In a process in which the intermediary transfer unit 50 is disposed at the image forming position, the tension roller 7, the driving roller 8 and the auxiliary roller 12 gradually enter the phantom plane F in the side where the photosensitive drums 1Y, 1M, 1C and 1K oppose the intermediary transfer unit 50. The stretching rollers enter the phantom plane F of two adjacent photosensitive drums 1 of the plurality of photosensitive drums 1 at a position of each of an upstream position of an upstream photosensitive drum and a downstream position of a downstream photosensitive drum with respect to the movement direction of the intermediary transfer belt 5. Specifically, in the image forming apparatus in this embodiment, the stretching roller positioned upstream of the photosensitive drum 1Y which is one of the upstream photosensitive drums 1Y and 1C is the tension roller 7, and the stretching roller positioned downstream of the photosensitive drum 1M which is one of the downstream photosensitive drums 1M and 1K is the auxiliary roller 12. Further, the stretching roller positioned upstream of the other upstream photosensitive drum 1C is the auxiliary roller 12, and the stretching roller positioned downstream of the other downstream photosensitive drum 1K is the driving roller 8.

Then, the gear 81 rotating integrally with the driving roller 8 is separated from the rack 82, so that the driving roller 8 is rotatable in an opposite direction, i.e., in an image forming direction. The bearing member 72 of the tension roller 7 is disengaged from the releasing means 73, so that the intermediary transfer unit 50 is mounted in the image forming apparatus main assembly 100M, i.e., disposed at the image forming position.

Substantially simultaneous therewith, fixing of the tension roller 7 by an unshown rotation-locking means is also released. This fixing is made for slacking the intermediary transfer belt 5 by sending, toward the photosensitive drums 1, the slackness of the intermediary transfer belt 5 generated by rotation of the driving roller 8 based on the engagement between the rack 82 and the gear 81 as described above. When the tension roller 7 is rotated, the intermediary transfer belt 5 sent toward the photosensitive drums 1 is moved as it is, so that the slackness cannot be left in the photosensitive drum 1 side. Therefore, when the intermediary transfer unit 50 is inserted in the image forming apparatus main assembly 100M, the tension roller 7 is fixed to be prevented from rotating.

A feature portion, of this embodiment, including the releasing means 73, the gear 81 and the rack 82 will be specifically described.

FIGS. 2 to 5 show the constitution in this embodiment.

In the image forming apparatus main assembly 100M in which the intermediary transfer unit 50 is inserted and mounted, as described above, the releasing means 73 engageable with the bearing member 72 of the tension roller 7 of the intermediary transfer unit 50 is disposed in the image forming apparatus main assembly side.

The releasing means 73 is provided at a position where the releasing means 74 contacts a rotational axis direction end portion of the bearing member 72 of the tension roller 7 at a rearmost portion of the unshown intermediary transfer unit inserting and pulling (dismounting) rail. The releasing means 73 is a substantially doglegged member having two surfaces substantially perpendicular to the arrow A3 direction, of FIG. 3, which is an inserting direction of the intermediary transfer unit 50. The (tension) releasing means 74 has an upper surface 73*a* extending in the substantially same direction as the inserting direction (arrow A2 direction) of the intermediary transfer unit 50 and a first surface 73*b* extending downward from the upper surface 73*a*. At the first surface 73*b*, the bearing member 72 of the tension roller 7 of the inserted intermediary transfer unit 50 contacts the releasing means 73. The releasing means 73 further has a second surface 73*c* positioned below the first surface 73*b* and at a further rear portion with respect to the inserting direction A2 of the intermediary transfer unit 50. A stepped portion formed by the first surface 73*b* and the second surface 73*c* is connected by an inclined surface 73*d* having moderate inclination. This inclined surface 73*d* alleviates an instantaneous impact (shock) exerted on the intermediary transfer unit 50 when the contact of the bearing member 72 of the tension roller 7 with the releasing means 73 is released from the releasing means 73 described later.

Substantially simultaneously with the contact of the bearing member 72 with the releasing means 73, the gear 81 provided on the driving roller 8 of the intermediary transfer unit 50 engages with the rack 82 disposed in the neighborhood of an end portion of the inserting and pulling rail in the image forming apparatus main assembly 100M in an entrance port side where the intermediary transfer unit 50 is inserted into the image forming apparatus main assembly 100M. The position of this rack 82 is a position where the rack 82 contacts the gear 81 in a state in which the tension of the intermediary transfer belt 5 is not loosened when the bearing member 72 of the tension roller 7 of the intermediary transfer unit 50 contacts the releasing means 73.

Figure 4:
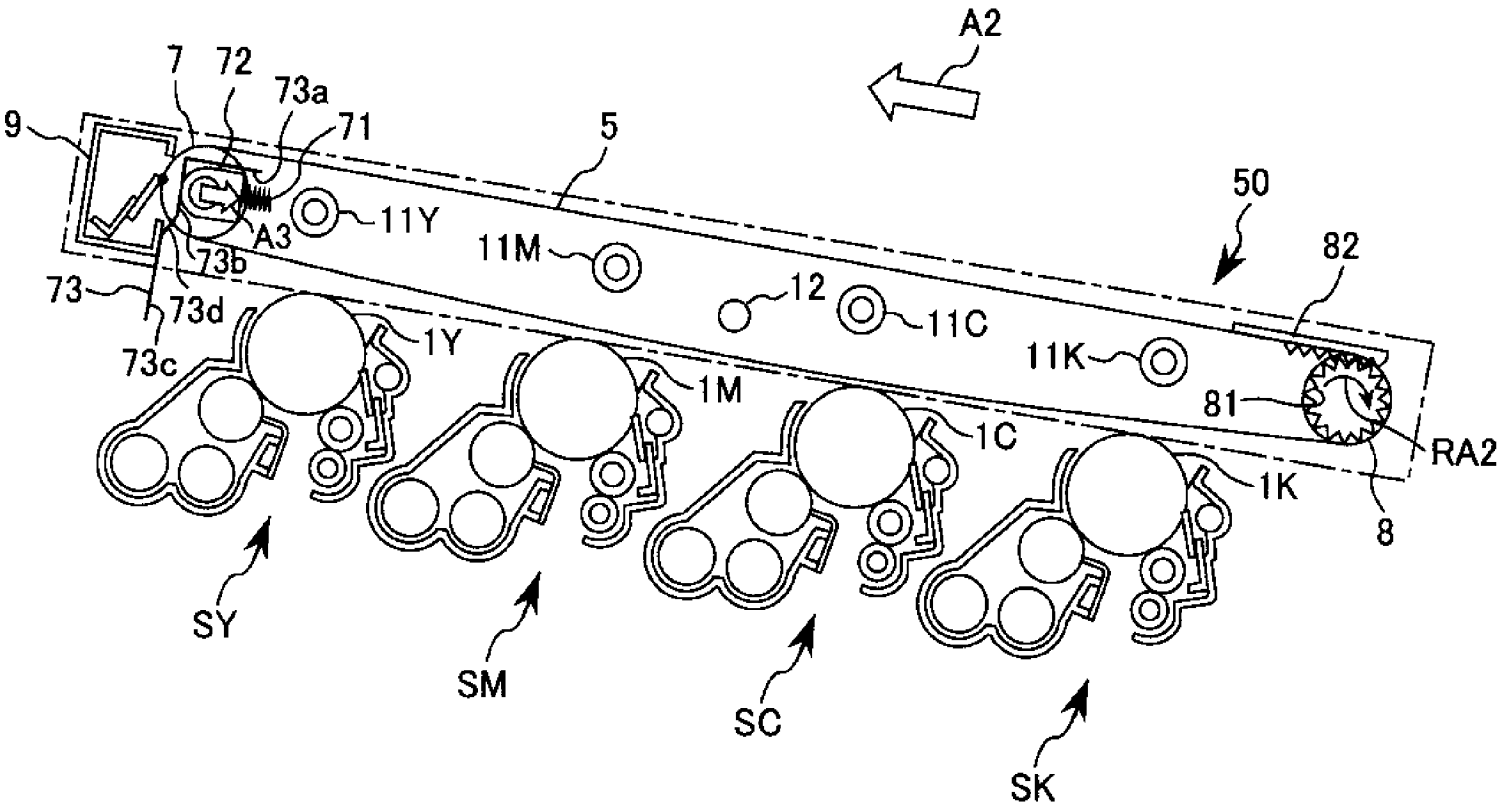

When the gear 81 engages with the rack 82, the driving roller 8 rotating integrally with the gear 81 by being inserted in the arrow A2 direction rotates in the arrow RA2 direction (clockwise direction) shown in FIGS. 3 and 4.

By the above-described contact with the releasing means 73 and the urging by the insertion in the arrow A2 direction, the bearing member 72 of the tension roller 7 of the intermediary transfer unit 50 is urged in the arrow A3 direction in the figures. As a result, the stretching of the intermediary transfer belt 5 by the tension roller 7 and the driving roller 8 and the tension by the tension spring 71 which urges the tension roller 7 are weakened. For that reason, the tension of the intermediary transfer belt 5 is loosened as a whole. By the rotation of the driving roller 8 in the arrow RA2 direction based on the above-described rotation of the gear 81 by the rack 82, the loosening of the intermediary transfer belt 5 is sent toward the side where the intermediary transfer belt 5 contacts the photosensitive drums 1. Further, the tension roller 7 including the bearing member 72 contacting the releasing means 73 is constituted so as not to rotate, during the insertion of the intermediary transfer unit 50 into the image forming apparatus main assembly 100M and the dismounting of the intermediary transfer unit 50 from the image forming apparatus main assembly 100M, by the unshown rotation-locking means. For this reason, the slackness (loosening) sent toward the contact side of the intermediary transfer belt 5 with the photosensitive drums 1 is accumulated in the contact side with the photosensitive drums 1 since the tension roller 7 does not rotate.

As a result, as shown in FIG. 4, the intermediary transfer belt 5 of the intermediary transfer unit 50 is in a state in which the slackness of the intermediary transfer belt 5 is provided in the contact side with the photosensitive drums 1.

In the state in which the slackness of the intermediary transfer belt 5 is provided, as shown in FIG. 5, the intermediary transfer unit 50 moves in the arrow A4 direction toward the photosensitive drums 1. At this time, the bearing member 72 of the tension roller 7 moves with the movement of the intermediary transfer unit 50 from the contact surface 73*b* of the releasing means 73 to a position opposing the surface 73*c* positioned further in the inserting direction A2 side of the intermediary transfer unit 50. As a result, the intermediary transfer belt 5 contacts the photosensitive drums 1 while releasing the contact of the bearing member 72 with the releasing means 73, i.e., while releasing the force exerted in the arrow A3 direction from the releasing means 73 to the bearing member 72. By releasing the contact of the bearing member 72 of the tension roller 7 with the releasing means 73, the tension by the tension spring 71 can be exerted on the intermediary transfer belt 5. However, as described above, the rotational drive of the tension roller 7 is stopped, and in addition, by the rotation of the gear 81 by the rack 82, the intermediary transfer belt 5 contacts the photosensitive drums 1 while being maintained in the state in which the intermediary transfer belt 5 has the slackness in the contact side with the photosensitive drums 1. As a result, when the intermediary transfer belt 5 contacts the photosensitive drums 1, friction does not readily generate between the intermediary transfer belt 5 and the photosensitive drum 1, so that a force by which the photosensitive drums 1 are rubbed (abraded) is weakened. As a result, the rubbing (sliding) of the photosensitive drums 1 with the intermediary transfer belt 5 is suppressed. Then, substantially simultaneously with the contact of the intermediary transfer belt 5 with the photosensitive drums 1, while the auxiliary roller 12 enters the phantom plane F, formed by the photosensitive drums 1, in the photosensitive drum (image bearing member) 1 side, the primary transfer rollers 11 contact the intermediary transfer belt 5 toward the photosensitive drums 1 while entering the phantom plane F of the photosensitive drums 1. At this time, the rack 82 is disengaged from the gear 81. Further, suppression of the rotation by the rotation-locking means which has suppressed the rotation of the tension roller 7 is released.

As described above, according to this embodiment, in the case where the intermediary transfer unit 50 is mounted in the image forming apparatus main assembly 100M, when the intermediary transfer belt 5 contacts the photosensitive drums 1, the tension is loosened, so that the surface, of the intermediary transfer belt 5, where the intermediary transfer belt 5 contacts the photosensitive drums 1 flexes. For this reason, a contact pressure of the intermediary transfer belt 5 to the photosensitive drums 1 is decreased, so that damages on the drums and the belt due to the rubbing between the intermediary transfer belt 5 and each of the photosensitive drums 1 can be suppressed to the minimum.

In addition to the case where the intermediary transfer unit 50 is mounted in the image forming apparatus main assembly 100M, also when the mounted intermediary transfer unit 50 is dismounted from the image forming apparatus main assembly 100M, an effect can be obtained. When the intermediary transfer unit 50 is dismounted from the image forming apparatus main assembly 100M, first, the intermediary transfer unit 50 is moved in a direction in which the intermediary transfer unit 50 is spaced from the photosensitive drums 1, i.e., a direction opposite to the arrow A4 direction. At this time, the bearing member 72 of the tension roller 7 of the intermediary transfer unit 50 contacts the first surface 73*b* of the releasing means 73 to move in a tension-slacking direction, i.e., the arrow A3 direction. At the same time, the gear 81 engages with the rack 82. At this time, the driving roller 8 itself is rotation-limited by the gear 81 engaging with the rack 82. Further, also the tension roller 7 is rotation-stopped by the rotation-locking means with start of a dismounting operation of the intermediary transfer unit 50. As a result, the intermediary transfer belt 5 is spaced and dismounted from the photosensitive drums 1 while maintaining the loosening of the intermediary transfer belt 5 which has been shifted toward the photosensitive drums 1 during the mounting, so that the operation can be performed in a state in which the contact pressure to the photosensitive drums 1 is suppressed to a low level. As a result, the damages on the drums and the belt due to the rubbing between the intermediary transfer belt 5 and each of the photosensitive drums 1 can be suppressed to the minimum.

As described above, according to this embodiment, by causing the rollers for stretching the intermediary transfer belt 5 to enter the photosensitive drum 1 side, it is possible to obtain a long lifetime of each of the intermediary transfer belt 5 and the photosensitive drums 1.

Embodiment 2

Figure 6:
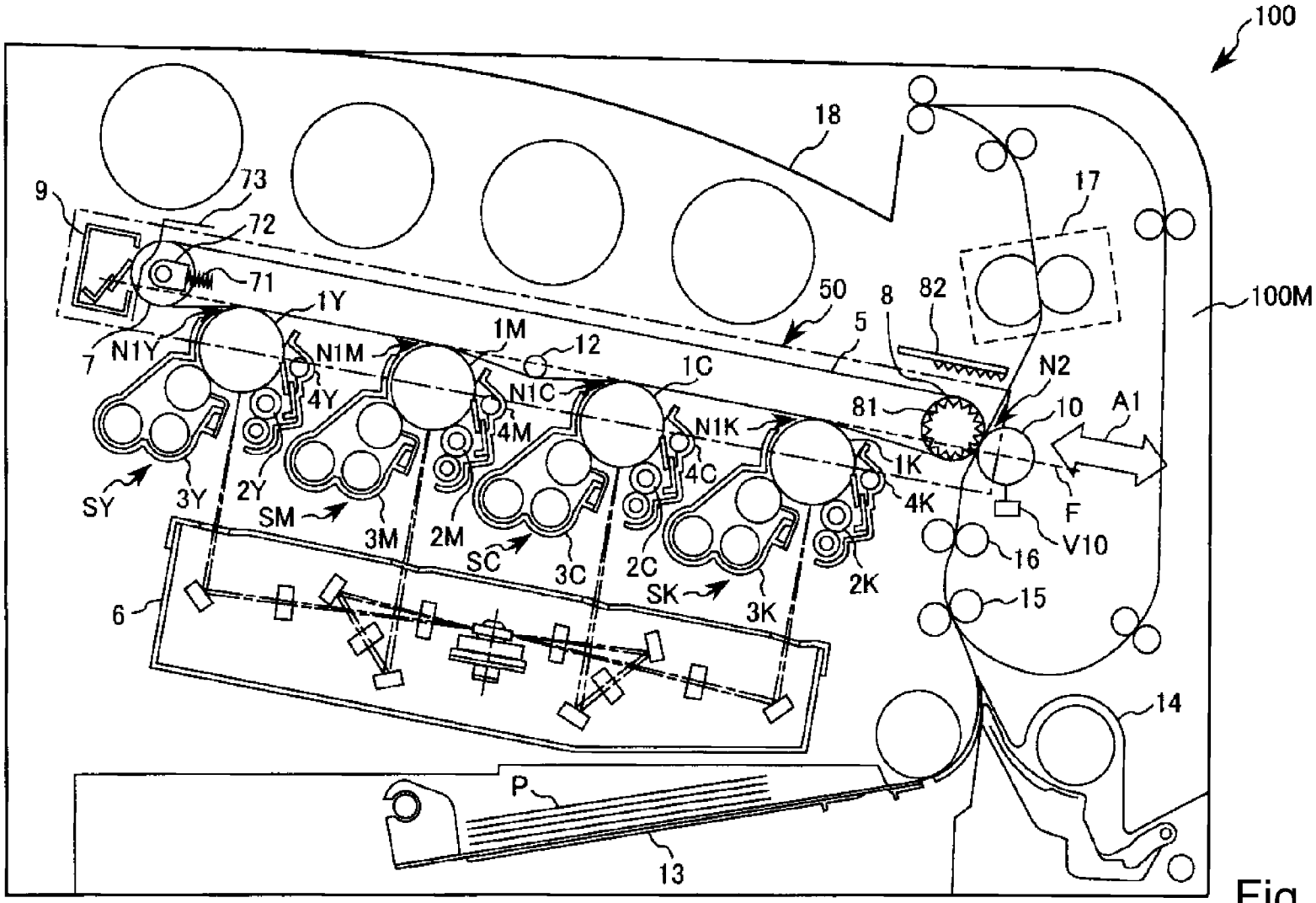
FIG. 6 is a schematic sectional view of an embodiment of an image forming apparatus in Embodiment 2.

FIG. 6 is a schematic sectional view showing an image forming apparatus 100 according to Embodiment 2.

The image forming apparatus 100 in this embodiment is not provided with the primary transfer rollers 11. Further, a primary transfer electric field is generated at a primary transfer portion, which is a contact portion between the intermediary transfer belt 5 and each of the photosensitive drums 1, from the secondary transfer roller 10 via an inner peripheral surface of the intermediary transfer belt 5 having a low resistance at the inner peripheral surface, so that the toner image is transferred from each of the photosensitive drums 1 onto the intermediary transfer belt 5. Other constituent elements and operations are substantially the same as those in Embodiment 1. Therefore, members having constitutions and functions similar to those of the image forming apparatus 100 in Embodiment 1 are represented by the same reference numerals or symbols and will be omitted from detailed description. Only a difference from Embodiment 1 will be described below.

Figure 7:
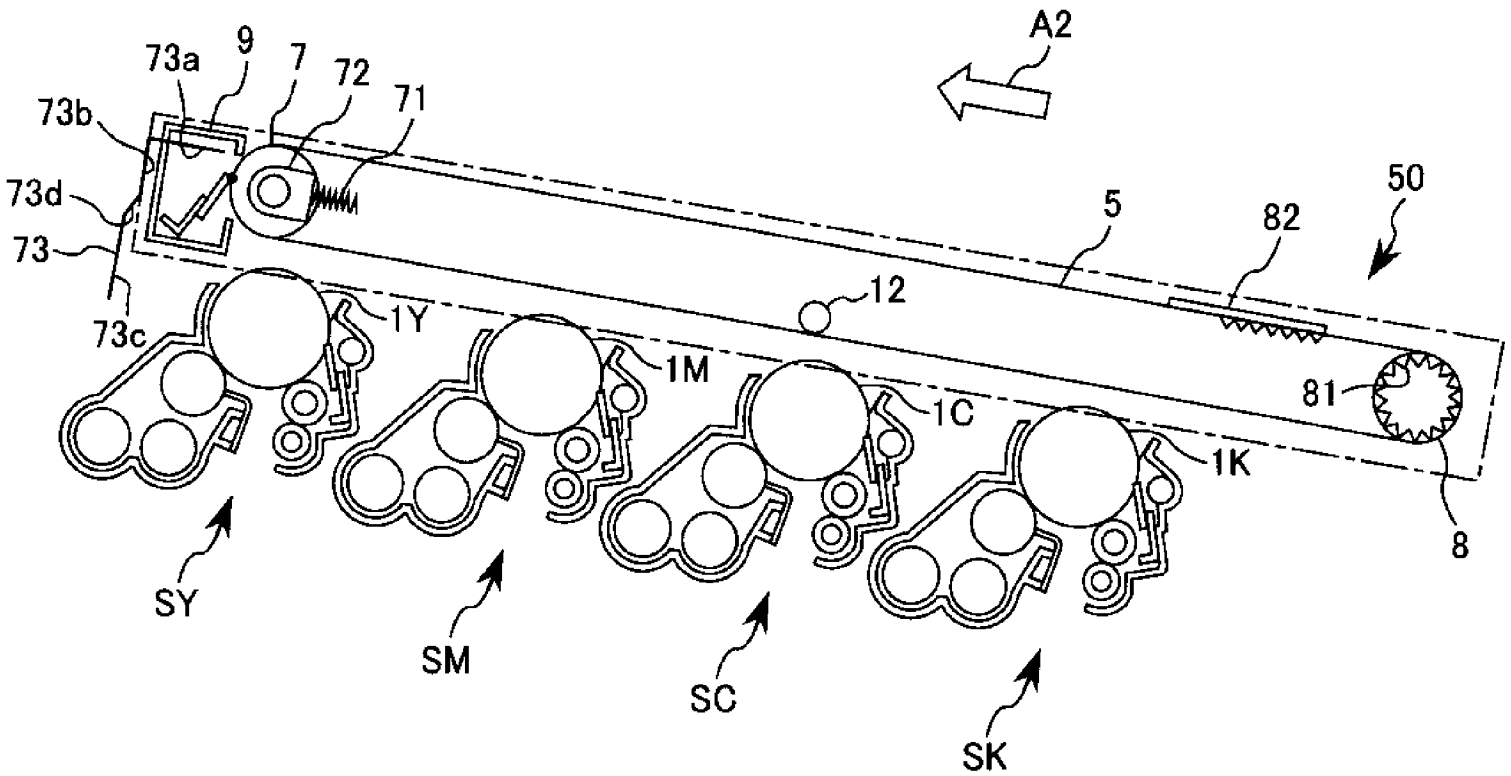
FIGS. 7 to 10 are schematic sectional views, of an image forming portion, for illustrating mounting of an intermediary transfer unit of the image forming apparatus in Embodiment 2.

FIG. 7 shows an intermediary transfer unit 50 which can be inserted into and dismounted from the image forming apparatus main assembly 100M of the image forming apparatus 100. The intermediary transfer unit 50 is constituted by the intermediary transfer belt 5, the tension roller 7, the driving roller 8, the auxiliary roller 12 and the intermediary transfer belt cleaner 9 similarly as in Embodiment 1, and can be inserted into and pulled out from the image forming apparatus main assembly 100M with respect to an arrow A1 direction along the intermediary transfer unit inserting and pulling rail (not shown) provided in the main assembly. In the image forming apparatus in this embodiment, the intermediary transfer belt 5 of the intermediary transfer unit enters the photosensitive drum side of phantom plane F and contacts the photosensitive drums 1 by the stretching rollers 7, 8 and 12. The image forming apparatus 100 receives the print instruction from the unshown external device such as the computer, and then starts the image forming operation. The toner images depending on first signals by the print instruction are formed on the photosensitive drums 1Y, 1M, 1C and 1K, and are primary-transferred from the photosensitive drums 1Y, 1M, 1C and 1K onto the intermediary transfer belt 5 at the primary transfer portions N1Y, N1M, N1C and N1K, respectively, which are contact portions each between the associated photosensitive drum 1 and the intermediary transfer belt 5, by being timed to the intermediary transfer belt 5. At this time, the primary transfer bias is applied through the secondary transfer roller 10 disposed at the opposing position to the driving roller 8 via the intermediary transfer belt 5 of the intermediary transfer unit 50 inserted and mounted in the image forming apparatus main assembly 100M. In this embodiment, as the intermediary transfer belt 5, e.g., an electroconductive belt of $1\times10^{7}$-$1\times10^{12}$ Ω·cm in volume resistivity is used.

The secondary transfer roller 10 contacts the intermediary transfer belt 5, and by a bias power source V10 connected to the secondary transfer roller 10, the primary transfer bias is applied to the intermediary transfer belt 5 at predetermined timing, so that the primary transfer is made. The toner images primary-transferred on the intermediary transfer belt 5 are secondary-transferred onto the sheet P at the secondary transfer portion N2 by applying the secondary transfer bias to the secondary transfer roller 10.

The stretching rollers which enter the photosensitive drum side of phantom plane F described above are the tension roller 7 positioned upstream of the photosensitive drums 1 with respect to the movement direction of the intermediary transfer belt 5, the driving roller 8 positioned downstream of the photosensitive drums 1 with respect to the movement direction of the intermediary transfer belt 5, and the auxiliary roller 12 positioned between the photosensitive drums 1M and 1C. A constitution in which these stretching rollers 7, 8 and 12 enter the phantom plane F and thus the intermediary transfer belt 5 winds about the photosensitive drums 1 is employed.

Next, an operation of the intermediary transfer unit 50 in the case where the intermediary transfer unit 50 is gradually inserted into the image forming apparatus main assembly 100M will be described with reference to FIGS. 7 to 10. Also in this embodiment, an operation similar to the operation in Embodiment 1 described with reference to FIGS. 2 to 5 is performed.

As shown in FIG. 7, when the intermediary transfer unit 50 is positioned outside the image forming apparatus, the intermediary transfer belt 5 is in a state in which the intermediary transfer belt 5 is stretched by only the tension roller 7 and the driving roller 8, and the intermediary transfer unit 50 is inserted into the image forming apparatus main assembly 100M in an arrow A2 direction. Similarly as in Embodiment 1 described with reference to FIG. 2, also in this embodiment, the intermediary transfer belt 5 positioned at a sandwiching portion is constituted so as to be immovable, due to a resistance thereof generated by being sandwiched between the intermediary transfer belt cleaner 9 and the tension roller 7, when the intermediary transfer belt 5 is not driven by the driving roller 8.

Figure 8:
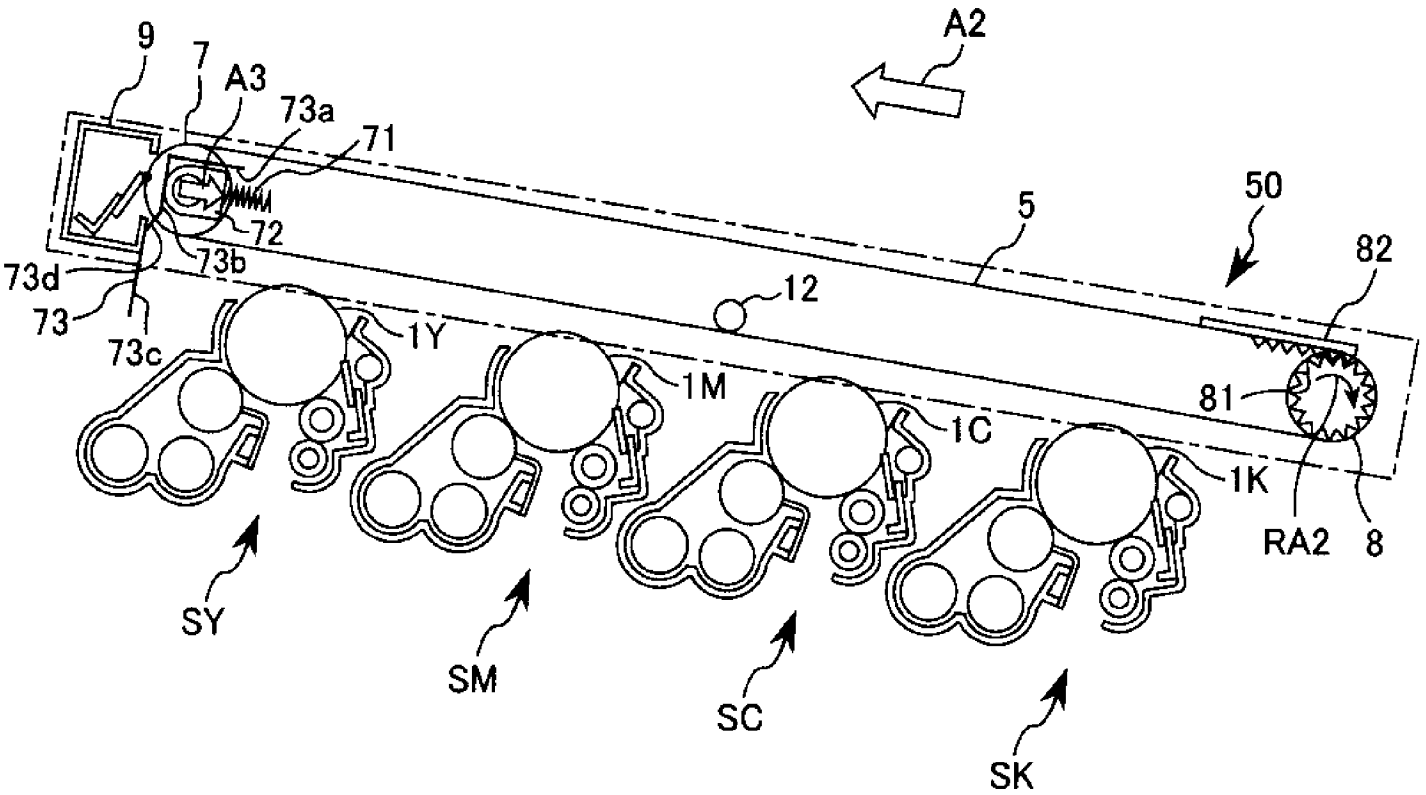
Figure 9:
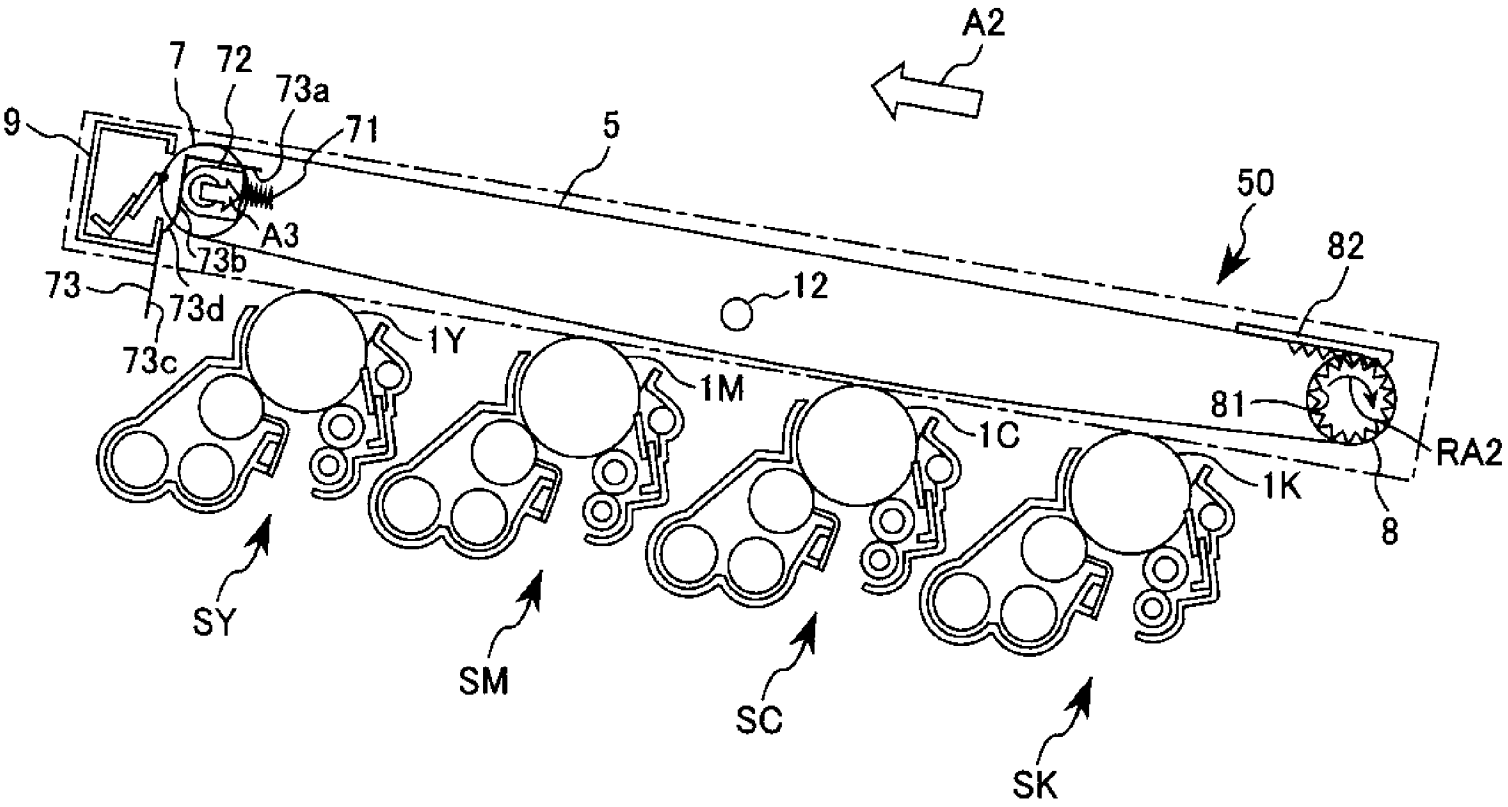

As shown in FIG. 8, when the intermediary transfer unit 50 is inserted in the arrow A2 direction, similarly as in the operation described in Embodiment 1 with reference to FIGS. 3 and 4, tension of the tension roller 7 is released, and by the rotation of the driving roller 8 in the arrow RA2 direction, slackness of the intermediary transfer belt 5 is generated relatively in a contact region side where the intermediary transfer belt 5 contacts the photosensitive drums 1. As a result, as shown in FIG. 9, at the side of the intermediary transfer belt 5 opposing the photosensitive drums 1, the state of the intermediary transfer belt 5 is changed to a slacked (loosened) state.

Figure 10:
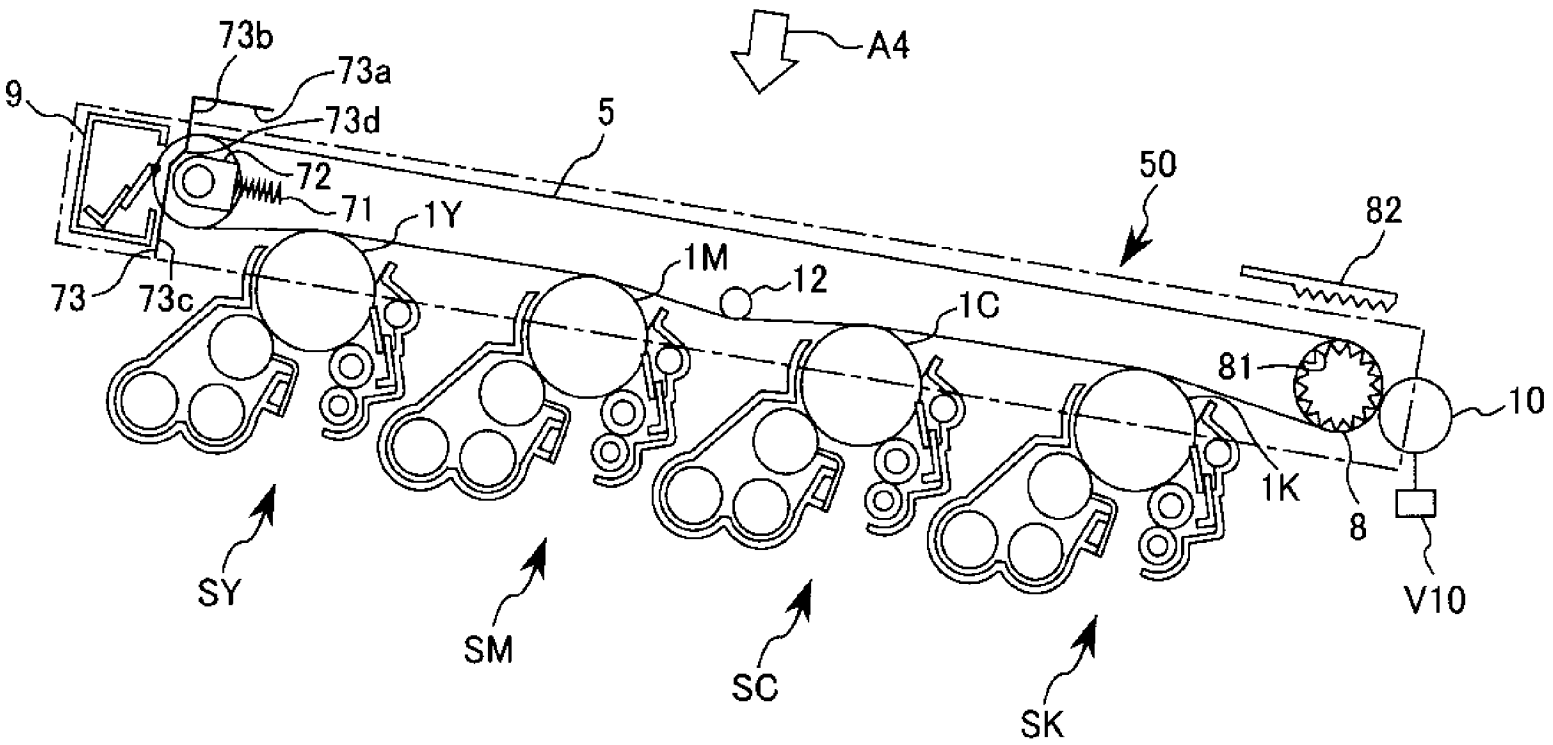
Figure 11:
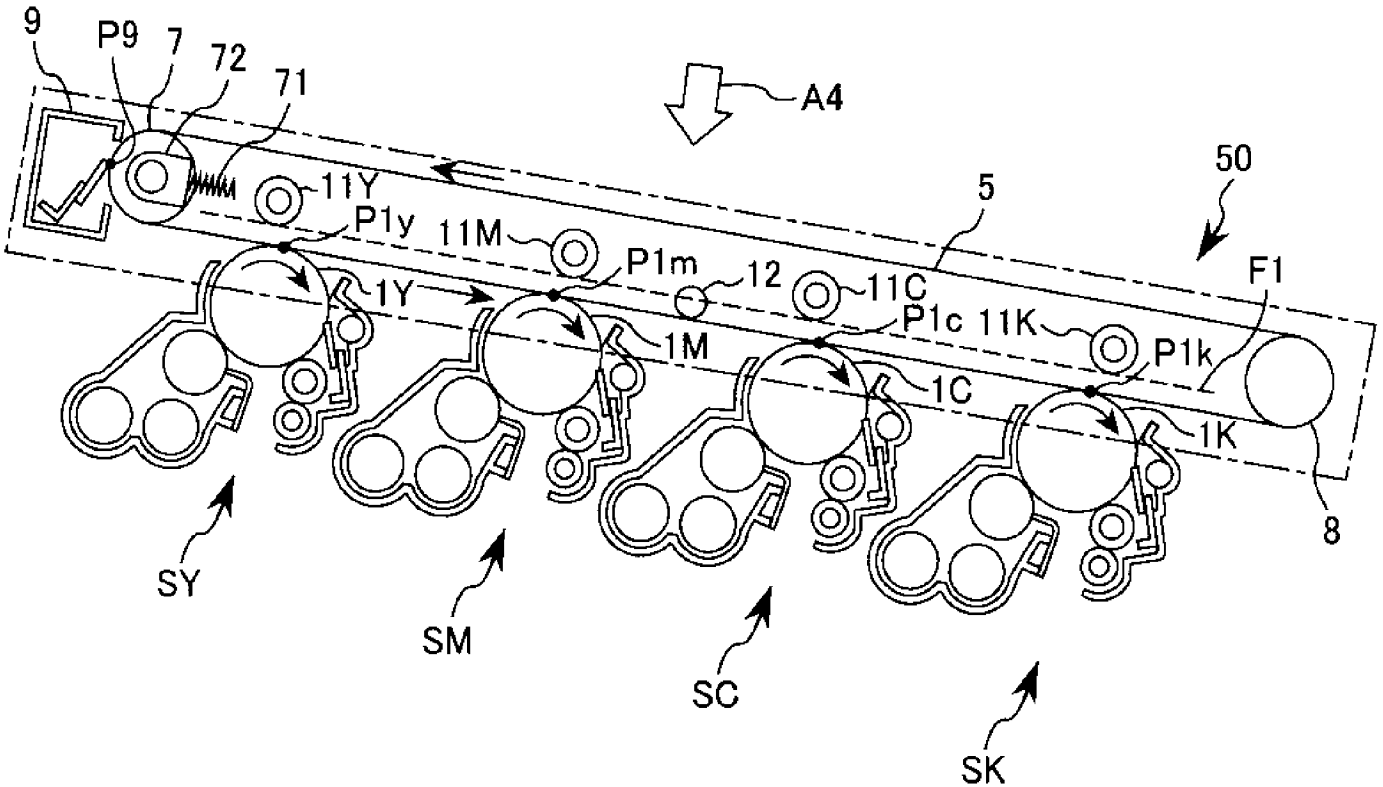
FIGS. 11 and 12 are schematic sectional views, of an image forming portion, for illustrating mounting of a conventional intermediary transfer unit.
Figure 12:
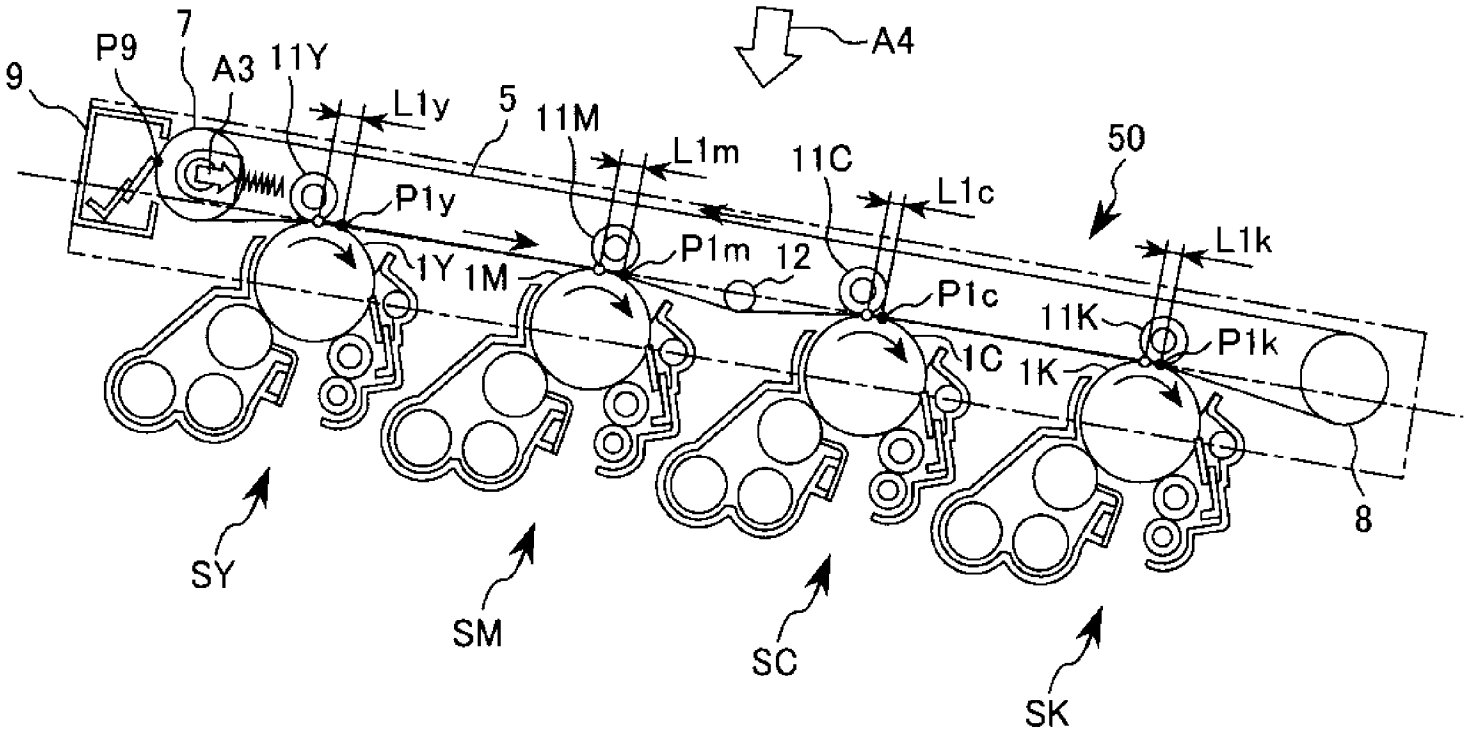

Thereafter, as shown in FIG. 10, similarly as in the operation described in Embodiment 1 with reference to FIG. 5, the intermediary transfer unit 50 is moved in an arrow A4 direction, so that the intermediary transfer belt 5 contacts the photosensitive drums 1Y, 1M, 1C and 1K. At this time, the tension roller 7, the driving roller 8 and the auxiliary roller 12 gradually enter the phantom plane F in the side where the photosensitive drums 1Y, 1M, 1C and 1K oppose the intermediary transfer unit 50.

Then, the gear 81 rotating integrally with the driving roller 8 is separated from the rack 82, so that the driving roller 8 is rotatable in an opposite direction, i.e., in an image forming direction. The bearing member 72 of the tension roller 7 is disengaged from the releasing means 73, so that the mounting of the intermediary transfer unit 50 in the image forming apparatus main assembly 100M is completed. The structure and the operation of the releasing means 73 are similar to those in Embodiment 1.

Simultaneously therewith, fixing of the tension roller 7 by an unshown rotation-locking means is also released. This fixing is made for loosening the intermediary transfer belt 5 by sending, toward the photosensitive drums 1, the slackness of the intermediary transfer belt 5 generated by rotation of the driving roller 8 based on the engagement between the rack 82 and the gear 81 as described above. When the tension roller 7 is rotated, the intermediary transfer belt 5 sent toward the photosensitive drums 1 is moved as it is, so that the slackness cannot be left in the photosensitive drum 1 side and therefore, when the intermediary transfer unit 50 is inserted in the image forming apparatus main assembly 100M, the tension roller 7 is fixed to be prevented from rotating.

As described above, in this embodiment described with reference to FIGS. 6 to 10, when the intermediary transfer belt 5 of the intermediary transfer unit 50 is contacted to the photosensitive drums 1, the slackness is provided to the intermediary transfer belt 5, so that a structure such that the friction is not generated as described above is employed.

Similarly as in Embodiment 1, also in this embodiment, in the case where the intermediary transfer unit 50 is mounted in the image forming apparatus main assembly 100M, when the intermediary transfer belt 5 contacts the photosensitive drums 1, the tension is slacked, so that the surface, of the intermediary transfer belt 5, where the intermediary transfer belt 5 contacts the photosensitive drums 1 flexes. For this reason, a contact pressure of the intermediary transfer belt 5 to the photosensitive drums 1 is decreased, so that damages on the drums and the belt due to the rubbing between the intermediary transfer belt 5 and each of the photosensitive drums 1 can be suppressed to the minimum.

As described above, in this embodiment, although the case where the intermediary transfer unit 50 is mounted in the image forming apparatus main assembly 100M is described, similarly as in Embodiment 1 also when the mounted intermediary transfer unit 50 is dismounted from the image forming apparatus main assembly 100M, an effect can be obtained.

As described above, also in the image forming apparatus including no primary transfer roller, it is possible to obtain a long lifetime of each of the intermediary transfer belt 5 and the photosensitive drums 1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 259431/2013 filed Dec. 16, 2013, which is hereby incorporated by reference.

What is claimed is:

1. An image forming apparatus comprising:

first and second image bearing members, each configured to bear a toner image;

a belt unit detachably mountable to a main assembly of said image forming apparatus, wherein said belt unit includes an endless belt onto which the toner images are to be transferred from said first and second image bearing members, at an image forming position where image formation is to be effected, in a contact state with said first and second image bearing members and includes first and second rollers, provided at an inner peripheral surface side of the belt, configured to stretch the belt, the first roller including a transmission portion;

a slackness forming unit, provided in the main assembly, configured to perform a first function of forming a belt slacking region, at least at a portion where the belt opposes said first and second image bearing members, by acting on said belt unit and configured to perform a second function of eliminating the belt slacking region, said slackness forming unit including a driving force transmitting member connected to the transmission portion to rotate the first roller by a force by which said belt unit is moved; and a guiding unit configured to guide, when said belt unit is inserted into the main assembly and is moved to the image forming position, said belt unit so that said slackness forming unit performs the first function in a state in which the belt is spaced from said first and second image bearing members and so that said slackness forming unit performs the second function in a state in which the belt slacking region contacts said first and second image bearing members.

2. An image forming apparatus according to claim 1, wherein when said belt unit is in the image forming position, the first and second rollers are positioned at a side of said first and second image bearing members with respect to a common contact plane of said first and second image bearing members in a belt unit side to form a contact region of the belt with each of said first and second image bearing members.

3. An image forming apparatus according to claim 1, wherein said belt unit includes an urging member configured to urge the second roller in an outside direction of the belt, wherein the second roller includes a portion-to-be-contacted on which said slackness forming unit is actable, and wherein said slackness forming unit includes a contact member configured to change a position of the second roller relative to the first roller in a direction parallel to an urging direction of the urging member by a force by which said belt unit is moved and by an urging force of the urging member while contacting the portion-to-be-contacted.

4. An image forming apparatus according to claim 1, wherein said guiding unit guides said belt unit along a first path and a second path in a listed order when said belt unit is inserted into the main assembly and is moved to the image forming position, and wherein the first path extends in a direction substantially parallel to a transfer surface on which the toner images are transferred from said first and second image bearing members, and the second path extends in a direction substantially perpendicular to the transfer surface.

5. An image forming apparatus according to claim 4, wherein with respect to a movement direction of said belt unit when said belt unit is inserted in the main assembly and is moved to the image forming position along the first path, the first roller is disposed at an upstream side and the second roller is disposed at a downstream side.

6. An image forming apparatus according to claim 4, wherein when said belt unit is inserted into the main assembly and is moved to the image forming position, said guiding unit causes said slackness forming unit to perform the first function in the first path and causes said slackness forming unit to perform the second function in the second path.

7. An image forming apparatus according to claim 4, wherein when said belt unit is moved from the image forming position until said belt unit is dismounted from the main assembly, said guiding unit causes said slackness forming unit to perform the first function in the second path and causes said slackness forming unit to perform the second function in the first path.

8. An image forming apparatus comprising:

an image bearing member configured to bear a toner image;

a belt unit detachably mountable to a main assembly of said image forming apparatus, wherein said belt unit includes an endless belt onto which the toner image is to be transferred from said image bearing member, at an image forming position where image formation is to be effected, in a contact state with said image bearing member and includes first and second rollers, provided at an inner peripheral surface side of the belt, configured to stretch the belt, the first roller including a transmission portion;

a slackness forming unit, provided in the main assembly, configured to perform a first function of forming a belt slacking region, at least at a portion where the belt opposes said image bearing member, by acting on said belt unit and configured to perform a second function of eliminating the belt slacking region, said slackness forming unit including a driving force transmitting member connected to the transmission portion to rotate the first roller by a force by which said belt unit is moved; and a guiding unit configured to guide, when said belt unit is inserted into the main assembly and is moved to the image forming position, said belt unit so that said slackness forming unit performs the first function in a state in which the belt is spaced from said image bearing member and so that said slackness forming unit performs the second function in a state in which the belt slacking region contacts said image bearing member.

* * * * *